United States Patent [19]

Peterson

[11] 4,373,162

[45] Feb. 8, 1983

[54] LOW FREQUENCY ELECTRONICALLY STEERABLE CYLINDRICAL SLOT ARRAY RADAR ANTENNA

[75] Inventor: Ralph W. Peterson, Minneapolis, Minn.

[73] Assignee: Control Data Corporation, Minneapolis, Minn.

[21] Appl. No.: 315,837

[22] Filed: Oct. 28, 1981

Related U.S. Application Data

[63] Continuation of Ser. No. 129,146, Mar. 10, 1980, abandoned.

[51] Int. Cl.[3] ..... H01Q 13/10

[52] U.S. Cl. ..... 343/771; 343/767

[58] Field of Search ..... 343/708, 703, 770, 771, 343/769

[56] References Cited

U.S. PATENT DOCUMENTS

| | | | |
|---|---|---|---|
| 2,523,461 | 10/1951 | Lindenblad | 250/25 |
| 2,573,461 | 10/1951 | Lindenblad | 250/25 |
| 2,635,188 | 4/1953 | Riblet | 343/769 |
| 2,977,595 | 3/1961 | Zisler et al. | 343/769 |
| 3,039,098 | 6/1962 | Bickmore | 343/771 |
| 3,074,063 | 1/1963 | Horton | 343/708 |
| 3,293,645 | 12/1966 | Farley et al. | 343/708 |
| 3,518,685 | 6/1970 | Jones, Jr. | 343/708 |
| 3,623,162 | 11/71 | Whittey | 343/767 |
| 3,662,392 | 5/1972 | Stapleton et al. | 343/708 |
| 4,063,246 | 12/1977 | Greiser | 343/700 MS |

*Primary Examiner*—David K. Moore

*Attorney, Agent, or Firm*—William J. McGinnis; Joseph A. Genovese

[57] ABSTRACT

This invention is an electronically steerable radar antenna which is on a cylinder section which is on the order of one wave length in circumference and in which the shape of the antenna elements on the cylinder section take the form of "O", "I" and "C" slots occupying about one-third the section circumference. Radar beams are steered by changing the phase and amplitude of the drive to the different elements of the antenna. The slots are formed as interruptions in an otherwise continuous, conductive ground plane and may be filled with dielectric if desired so that there is no surface discontinuity.

2 Claims, 5 Drawing Figures

LOW FREQUENCY ELECTRONICALLY STEERABLE CYLINDRICAL SLOT ARRAY RADAR ANTENNA

This is a continuation of application Ser. No. 129,146, filed Mar. 10, 1980, and now abandoned.

BACKGROUND OF THE INVENTION

This invention relates to slot array radar antennas of the type typically formed in an antenna pod and adapted for being carried by an aircraft. More particularly, this invention relates to a slot array antenna where the slots have a novel configuration and in which the antenna pod structure is comparatively small as compared to the prior art for the frequencies involved. The slots of the present invention are physical interruptions or cuts in an otherwise continuous ground plane and the slots form the elements of a radar antenna. The prior art also refers to certain surfacemounted or stripline slot antennas as simply "slot" antennas and these are totally different from applicant's invention.

Applicant is aware of U.S. Pat. No. 3,074,063 which shows a circumferential slot array radar antenna on a cylindrical cavity and designed to radiate uniformly in a radial direction. Applicant's invention is a steerable antenna having a particular shaped slot array and is different from the patent.

U.S. Pat. No. 3,293,645 and U.S. Pat. No. 3,518,685 also show slot array radar antennas but do not anticipate applicant's invention.

U.S. Pat. No. 2,573,461 shows a slot array antenna backed by a cavity in a cylindrical environment and in which the antenna is steerable. However, the design of this antenna does not anticipate applicant's invention.

U.S. Pat. No. 3,623,162 shows a particular shaped slot array radar antenna, namely, a bow tie slot shape, adapted to the shape of an air foil edge such as a wing edge, however, and not to a cylinder. Finally, U.S. Pat. No. 4,063,246 shows another development in slot array radar antennas but which also does not anticipate applicant's invention.

Generally, slot radar antenna pods are well-known in the art and the advancement of the present invention relates to the shape and configuration of particular slots on a cylindrical surface. It can be shown theoretically that a slot antenna is the current source analog to a dipole antenna driven by a voltage source.

SUMMARY OF THE INVENTION

Particular applications of radar to modern aircraft require the use of radar frequencies in the range of 20 to 200 MHz. At the low frequency end of this radar spectrum a simple dipole radar antenna could be as long as 25 feet and would generally be a significant encumbrance to a modern high speed aircraft having a small physical configuration. Slot radar antenna are physical and electrical interruptions in an otherwise continuous surface. Slot antennas should also be about one-half wave length long at the center frequency of the radar frequency spectrum employed with the antenna. Thus, at 60 MHz a half wave length is slightly greater than 98 inches. The circumference of a cylindrical pod available for a radar antenna structure on a modern aircraft may be only slightly greater than 100 inches. Moreover, vertical radar antenna slots radiate horizontally polarized radar signals and this imposes a limit that vertical slots should not cover more than about one-third the circumference of the pod if a desirable shaped radar radiation pattern is to be achieved. Thus, a new structure for a radar slot antenna was required in order to employ the particular frequency spectrum in question on particular types of small modern aircraft.

It has been discovered that flush mounted radar antenna at low radar frequencies, such as under 100 MHz and more particularly in the 30 to 60 MHz range, can be constructed on cylindrical structures having a maximum circumference of approximately 100 inches by employing radar slot antennas which take a configuration in the shape of a "I", "C" and "O" slot pattern. The driving transmission line is connected to the center section of the "I", "C", or "O" shaped antenna which is the vertical portion on a printed page or the transverse portion in a real antenna. These slots are top and bottom loaded by the top and bottom horizontal (on paper) or longitudinal (in a real structure) portions of the antenna. Steering may be accomplished by having multiple slots forming the elements of the antenna array. By varying the amplitude and phase of the signals to the individual slots in the antenna array, the radar beam may be steered and shaped. As such, steering and shaping of radar beams are well-known in the art. What is new is the particular slot configurations of the present invention.

IN THE FIGURES

FIG. 1 shows a pair of "O" radar slot antennas according to the present invention on a cylindrical configuration, FIG. 2 schematically shows a drive system for steering the antenna system of FIG. 1, FIG. 3 shows a single "I" radar slot antenna on a cylindrical configuration, FIG. 4 shows a single "C" radar slot antenna on a cylindrical configuration, and FIG. 5 shows a meander line slot antenna according to the present invention.

DESCRIPTION OF THE PREFERRED EMBODIMENTS

Figure 1:
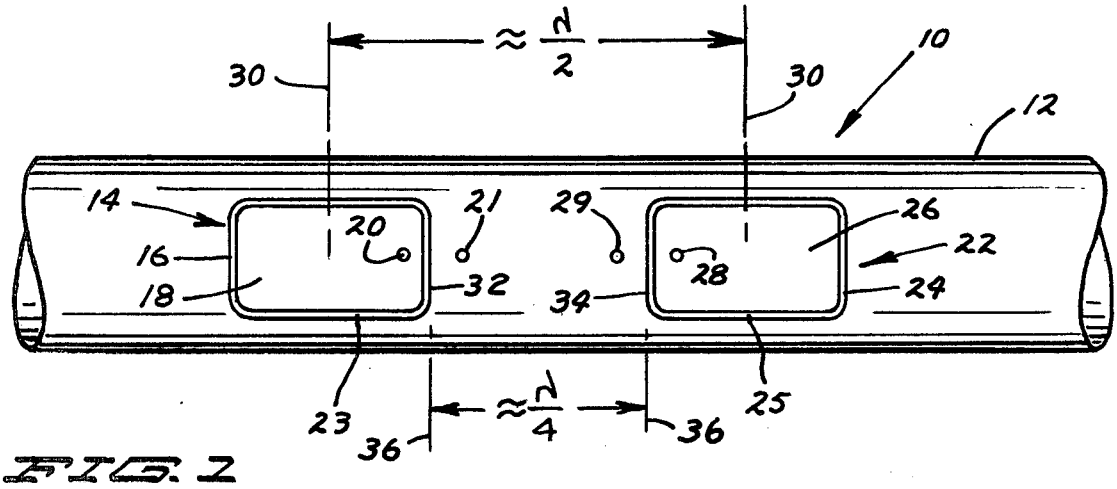

Referring now to FIG. 1, a radar slot antenna system 10 according to the present invention is shown. Shown schematically is a cylindrical structure 12 which represents the main fuselage or pod of an aircraft. Naturally, such a structure is normally constructed of electrically conductive material such as metal which functions as a ground plane for the radar structure. A first "O" slot 14 is configured on the cylinder 12 at a forward position and occupies generally less than one-third of the circumference of the cylinder 12. The structure 14 consists of a slot 16 forming a physical nonconductive interruption in the conductive cylinder 12 and on the order of a very small fraction of a wave length in width. The center of the "O" is a conductive element 18 properly supported by means not shown. An antenna connection point 20 is provided to this conductive element 18 midway on one of the vertical sides of the "O" slot shape where vertical is the transverse direction with respect to the cylinder 12 and the top and bottom or horizontal parts of the "O" slot shape are considered to be the parts that run longitudinally with the cylinder 12. Similarly, an antenna connection point 21 is provided on cylinder 12 proximate to and longitudinaly related to point 20. As shown in FIG. 1, the "O" slot shape may be flattened so that in fact the radar antenna element 14 has a greater dimension in the longitudinal direction with respect to the cylinder 12 than in the transverse direction. Similarly, a second "O+ slot array antenna 22 is positioned on cylinder 12 and has a similar structure to that of slot antenna 14 having a slot 24 with center conductive element 26. Connection points 28 and 29 for antenna element 22 are provided on the transverse side of the "O" slot facing "O" slot 14. Dielectric material 23 in slot 16, and dielectric material 25 in slot 24 may be used to make a continuous smooth surface for air flow purposes.

These two "O" slot antenna elements 14 and 22 form a steerable radar antenna. At least two elements are needed for a steerable antenna and more elements may be used if desired to increase antenna resolution. What is critical in the two element antenna is that the central portions of antennas 14 and 22 are approximately one-half wave length apart as shown at 30 in the drawing figure. The adjacent transverse sides of the "O" slots 14 and 22 will herein be designated as sides 32 and side 34, respectively, where the antenna attachment points 20 and 21 together with 28 and 29 are located. These sides 32 and 34 should be approximately one-quarter wave length apart at the radar frequency of intended use as shown in the drawing at 36.

Figure 2:
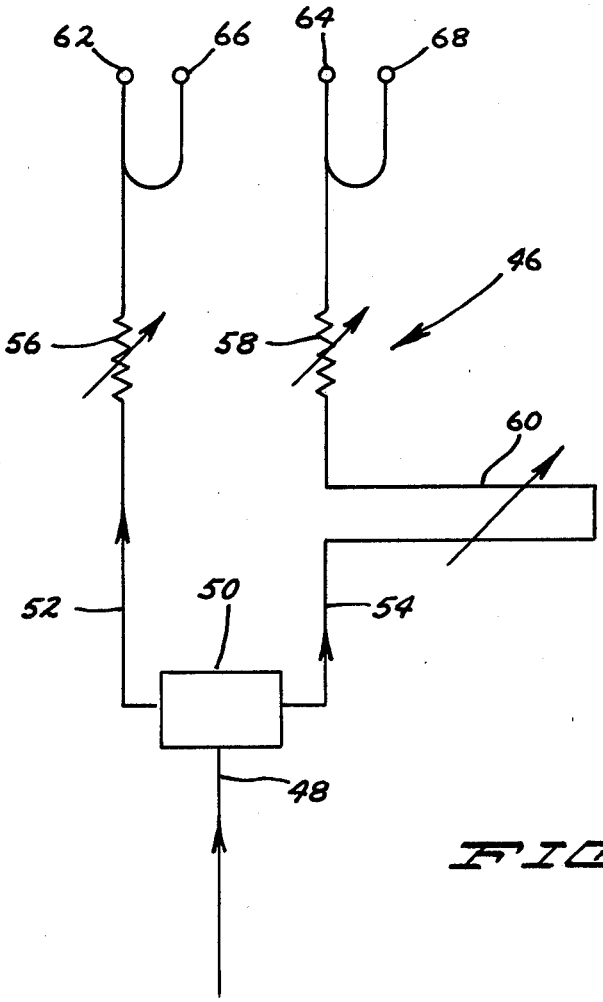

Referring now to FIG. 2, a schematic diagram is shown of the electrical system needed to connect the radar antenna array of FIG. 1 to a radar transmitter for steering operation. The antenna drive system 46 has a source of transmitter input power at 48 to a power divider network 50 from which two transmission lines 52 and 54 appear. An adjustable attenuator 56 is established in transmission line 52 and a similar attenuator 58 is established in transmission line 54. Transmission line 54 also has an adjustable phase shift device 60 therein. Thus, both lines have attenuators and the phase and amptitude of the transmission lines with respect to each other may be shifted. Each transmission line terminates in a direct connection point labeled as 62 with respect to transmission line 52 and labeled as connection point 64 with respect to transmission line 54. Each transmission line also has a balun type termination formed with a half-wave loop of coaxial cable and shown as a loop connection point to a second termination 66 in respect to transmission line 52 and 68 in respect to transmission line 54 for diagrammatic purposes in the figure. This system would be connected to the radar antenna shown in FIG. 1 in the following fashion. Connection point 62 of the power source shown in FIG. 2 would be connected to the antenna connection point 20 while source point 66 would be connected to antenna termination 21, transmission connection 64 to antenna connection 29 and finally transmission source connection 68 connected to antenna connection point 28. Any conventional unbalanced to balanced antenna termination method, such as a transformer, may be used, however.

Figure 3:
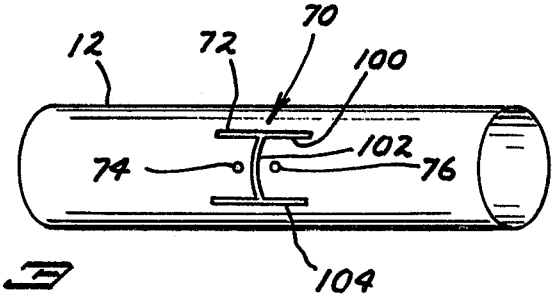

Referring now to FIG. 3, cylinder 12 also forms basis for the structure for an "I" slot antenna 70 shown schematically which again has a slot 72 in the conductive surface of cylinder 12. On both sides of the transverse element of the "I" slot there are connection points 74 and 76, respectively, to the electrically conductive cylinder 12. An array of "I" slots may be formed just as the array of "O" slots as shown in FIG. 1 and a connection to a power source may be implemented by a system like that shown in FIG. 2. An advantage of the "I" slot configuration is structured symmetry which generates a symmetric radiation pattern.

Figure 4:
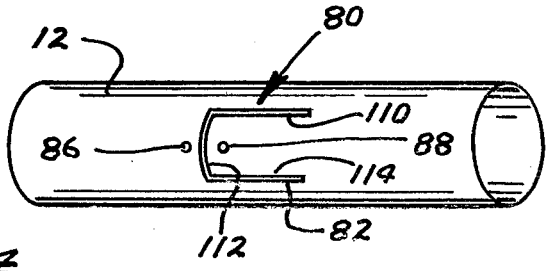

Similarly, FIG. 4 shows a "C" slot antenna 80 formed in a conductive cylinder 12 with a slot 82. A pair of electrical attachment points 86 and 88 similarly conduct electricity to the surface of cylinder 12. Also, similarly, an array of "C" slots may be formed as shown in FIG. 1 and driven by a system such as that shown in FIG. 2 to provide a steerable radar antenna.

Each of the various slots configurations shown in the figures has the following characteristics. The "O" slot antenna shown in FIG. 1 must be one wave length in circumference. The "I" slot antenna shown in FIG. 3 must be configured so that each side is one-half wave length in total length where a side is defined as the length of the transverse portion of the "I" with respect to the cylinder and the length of the two portions longitudinal with respect to the cylinder. To further define this dimension, surfaces 100, 102 and 104 of the "I" slot must total one-half wave length in length and the slot array must be symmetrical so that the corresponding elements on the other side of the "I" also have the same characteristics. Further, the internal surfaces of the "C" slot antenna shown in FIG. 4 consisting of surfaces 110, 112 and 114 must total one-half wave length in total length.

Figure 5:
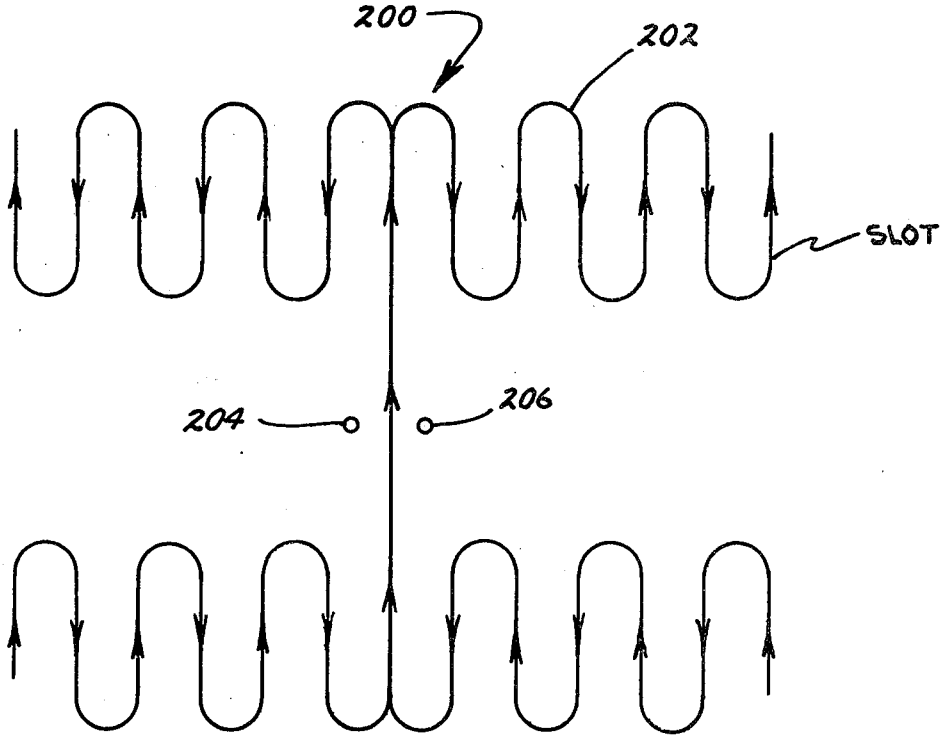

FIG. 5 schematically shows a meander line "I" slot antenna 200. The antenna is formed so that the longitudinal legs have a zig-zag configuration so that the electrical length is the required length and longer than the physical length occupied by the antenna. The top and bottom legs of any of these slots support non-radiating or transmission line modes. These longitudinal legs serve only to extend the total slot lengths to a half a wave in length. Space is saved by forming these longitudinal portions of the slot into meander lines 202 as shown in FIG. 5. Electrical attachment points 204 and 206 are similar to other forms of the antenna. Note the manner in which the field propagates along the meander lines and observe that these do not contribute to the radiated field. The long central portion of the slot is by far the principal contributor to the radiated field. Naturally "O" and "C" slots may be designed in the same way.

What is claimed is:

1. A radar antenna for frequencies in the 30 to 60 MHz range consisting of an array of "O" slot radar antennas wherein at least two "O" slot radar antennas, each antenna having a pair of parallel longitudinal portions and a pair of parallel transverse portions connected in the shape of a rectangle, are positioned on a conductive cylinder having a circumference not greater than 100 inches and each "O" slot antenna occupies less than one-third of the circumference of the cylinder and each of said antennas has a pair of connection points to a transmission line on one of said portions of said slot antenna transverse to the axis of the cylinder and wherein said connection point pairs for said slot antenna are in transverse portions approximately one-quarter wave length apart from one another and wherein each of said slot antennas has a total antenna length of approximately one wave length and wherein said slot antennas have the centers thereof approximately one-half wave length apart for the frequency of design and in which the continuous slot element defining the "O" shape of each antenna is a continuous physical and electrical interruption on the order of a very small fraction of a wave length in width and which forms a center conductive element which is the center of the "O" shape electrically isolated from said cylinder and to which one of said pair of connection points to a transmission line is fixed.

2. A radar slot antenna for frequencies in the 30 to 60 MHz range comprising a conductive generally cylindrical surface having a circumference not greater than 100 inches and a slot antenna element which is a physical and electrical interruption in the otherwise continuous conductive surface and wherein said slot antenna consists of at least one portion transverse to the axis of said cylinder having a primary affect of generating a radiated propagating radio wave and at least one portion of said slot antenna longitudinally oriented with respect to the axis of said cylinder and having the primary affect of acting as a transmission line to increase the effective total length of all the elements of the slot antenna to be not less than one-half wave length at the frequency of the radar system and wherein said antenna is an "O" shaped slot antenna, having a pair of parallel longitudinal portions and a pair of parallel transverse portions connected in the shape of a rectangle, occupying less than one-third of the circumference of the cylinder and having an internal slot length of not less than one wave length and having a connection termination pair for a transmission line on a portion of the slot transverse to the axis of the cylinder and in which the continuous slot element defining the "O" shape is on the order of a very small fraction of a wave length in width and forms a conductive element which is the center of the "O" shape electrically isolated from said cylinder and to which one of said connection termination pair for a transmission line is fixed.

* * * * *